US006864413B2

(12) United States Patent
Shiiya

(10) Patent No.: US 6,864,413 B2
(45) Date of Patent: Mar. 8, 2005

(54) ENSEMBLE SYSTEM, METHOD USED THEREIN AND INFORMATION STORAGE MEDIUM FOR STORING COMPUTER PROGRAM REPRESENTATIVE OF THE METHOD

(75) Inventor: Yoshihiro Shiiya, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 163 days.

(21) Appl. No.: 10/342,880

(22) Filed: Jan. 14, 2003

(65) Prior Publication Data

US 2003/0131717 A1 Jul. 17, 2003

(30) Foreign Application Priority Data

Jan. 16, 2002 (JP) ..... 2002-007725

(51) Int. Cl.[7] ..... G10H 1/36; G10H 7/00

(52) U.S. Cl. ..... 84/610; 84/609; 84/616; 84/634; 84/649; 84/650; 84/654

(58) Field of Search ..... 84/600–602, 609–612, 84/615–616, 622–625, 634, 649–654, 659–660, 666

(56) References Cited

U.S. PATENT DOCUMENTS 4,508,001 A * 4/1985 Suzuki ..... 84/604
5,189,237 A 2/1993 Koguchi
5,847,303 A * 12/1998 Matsumoto ..... 84/610
6,160,213 A 12/2000 Arnold et al.
6,737,571 B2 * 5/2004 Furukawa ..... 84/610
2003/0101862 A1 * 6/2003 Furukawa ..... 84/610

FOREIGN PATENT DOCUMENTS

EP 1 103 973 5/2001

* cited by examiner

*Primary Examiner*—Marlon T. Fletcher
(74) *Attorney, Agent, or Firm*—Morrison & Foerster LLP

(57) ABSTRACT

An ensemble system reproduces a performance on an automatic player piano expressed by a set of MIDI music data codes in ensemble with another performance recorded in a compact disc in the form of audio data codes; the ensemble system firstly determines the pitch of the fundamental tone produced through vibrations of a string, then searching the audio data codes for a corresponding tone, calculating a ratio between the pitch of the fundamental tone and the pitch of the corresponding tone, and determining a data read-out speed for the audio data codes; while the MIDI data codes are being supplied to the automatic player piano, the audio data codes are transferred to a speaker system at a speed equal to the product between the standard speed and the ratio so that the piano tones are well harmonized with the electronic tones.

19 Claims, 7 Drawing Sheets

ENSEMBLE SYSTEM, METHOD USED THEREIN AND INFORMATION STORAGE MEDIUM FOR STORING COMPUTER PROGRAM REPRESENTATIVE OF THE METHOD

FIELD OF THE INVENTION

This invention relates to an ensemble controlling technology and, more particularly, to an ensemble system, a method for ensemble between plural sound sources and an information storage medium for storing a computer program for the ensemble.

DESCRIPTION OF THE RELATED ART

In the following description, term "MIDI music data codes" is representative of digital codes formatted in accordance with MIDI (Musical Instrument Digital Interface) standards, and term "digital data codes" is representative of digital codes storing discrete values of an analog audio signal for a CD-ROM (Compact Disc-Read Only Memory).

An automatic player piano is an example of a composite keyboard musical instrument responsive to the MIDI music data codes for reproducing a music performance through acoustic piano tones, and a compact-disc player is used for playback of a piece of music from a CD-ROM. The MIDI music data codes are not compatible with the digital data codes. This means that a controller is required for an ensemble between the compact-disc player and the automatic player piano.

The prior art controller concurrently initiates the playback of the recorded performances. The compact disc player sequentially reads out the digital data codes from the compact disc, and restores the analog audio signal. The analog signal is supplied to a sound system, and is converted to electric tones in a part assigned thereto.

On the other hand, the automatic player piano reads out the MIDI music data codes from a floppy disc, and determines the keys to be moved, loudness of piano tones to be reproduced and times at which the keys are to be moved. When the times come, the automatic player piano selectively supplies driving signals to solenoid-operated key actuators so that the solenoid-operated key actuators give rise to the motion of the associated keys. Then, the action units are actuated, and, accordingly, the hammers are driven for rotation. The hammers strike the strings, and the acoustic piano tones are generated from the vibrating strings. Thus, the compact disc player and automatic player piano perform an ensemble.

However, a problem is encountered in the ensemble in that the electric tones are less consonant with the acoustic piano tones.

SUMMARY OF THE INVENTION

It is therefore an important object of the present invention to provide an ensemble system, which makes the first sort of tones in consonance with the second sort of tones.

It is also an important object of the present invention to provide a method used in the ensemble system.

It is also an important object of the present invention to provide an information storage medium, in which a computer program representative of the method is stored.

The present inventor contemplated the problem inherent in the prior art ensemble controller, and noticed that the electric tones did not always have pitches strictly equal to the pitches of the corresponding pitch of the acoustic piano tones. The musical instrument used in either recording or automatic playing might have been out of the tune. A player might have intentionally changed the standard pitch. The present inventor concluded that the difference in pitch were to be controlled the different sorts of tones.

To accomplish the object, the present invention proposes to change the pitches of one sort of tones by changing the data read-out speed. In accordance with one aspect of the present invention, there is provided an ensemble system for concurrently producing a first sort of tones and a second sort of tones comprising a first sound source for producing the first sort of tones, a second sound source for producing the second sort of tones, a first data source storing pieces of music data information representative of the first sort of tones and an ensemble controller connected to the first sound source, the second sound source and the first data source, and achieving at least first, second and third tasks for producing the first sort of tones concurrently with the second sort of tones, the ensemble controller determines a pitch of one of the tones of the second sort actually produced by the second sound source in the first task, the ensemble controller determines a data read-out speed on the basis of a ratio between the pitch of the aforesaid one of the tones and a pitch of a corresponding tone of the first sort to be equivalent in pitch to the aforesaid one of the tones through an analysis on selected ones of the pieces of music data information in the second task for adjusting the tones of the first sort to pitches different from the pitches represented by the pieces of music data information by a predetermined offset value, and the ensemble controller transfers the pieces of music data information from the first data source to the first sound source at the data read-out speed in the third task so that the first sound source produces the tones of the first sort concurrently with the tones of the second sort produced by the second sound source.

In accordance with another aspect of the present invention, there is provided a method for producing a first sort of tones concurrently with a second sort of tones comprising the steps of determining a pitch of one of the tones of the second sort and a pitch of a corresponding tone of the first sort to be equivalent in pitch to the aforesaid one of the tones, determining a data read-out speed on the basis of a ratio between the pitch of the aforesaid one of the tones and the pitch of the corresponding tone for adjusting the tones of the first sort to pitches different from the pitches of the tone of the first sort by an offset value, and reading out pieces of music data information representative of the tones of the first sort from an information storage medium at the data read-out speed for producing the tones of the first sort concurrently with the tones of the second sort.

In accordance with yet another aspect of the present invention, there is provided an information storage medium storing a computer program representative of a method for producing a first sort of tones concurrently with a second sort of tones, and the method comprises the steps of determining a pitch of one of the tones of the second sort and a pitch of a corresponding tone of the first sort to be equivalent in pitch to the aforesaid one of the tones, determining a data read-out speed on the basis of a ratio between the pitch of the aforesaid one of the tones and the pitch of the corresponding tone for adjusting the tones of the first sort to pitches different from the pitches of the tone of the first sort by an offset value and reading out pieces of music data information representative of the tones of the first sort from an information storage medium at the data read-out speed for producing the tones of the first sort concurrently with the tones of the second sort.

BRIEF DESCRIPTION OF THE DRAWINGS

The features and advantages of the ensemble system, method and information storage medium will be more clearly understood from the following description taken in conjunction with the accompanying drawings, in which.

DESCRIPTION OF THE PREFERRED EMBODIMENT

Ensemble System

Figure 1:
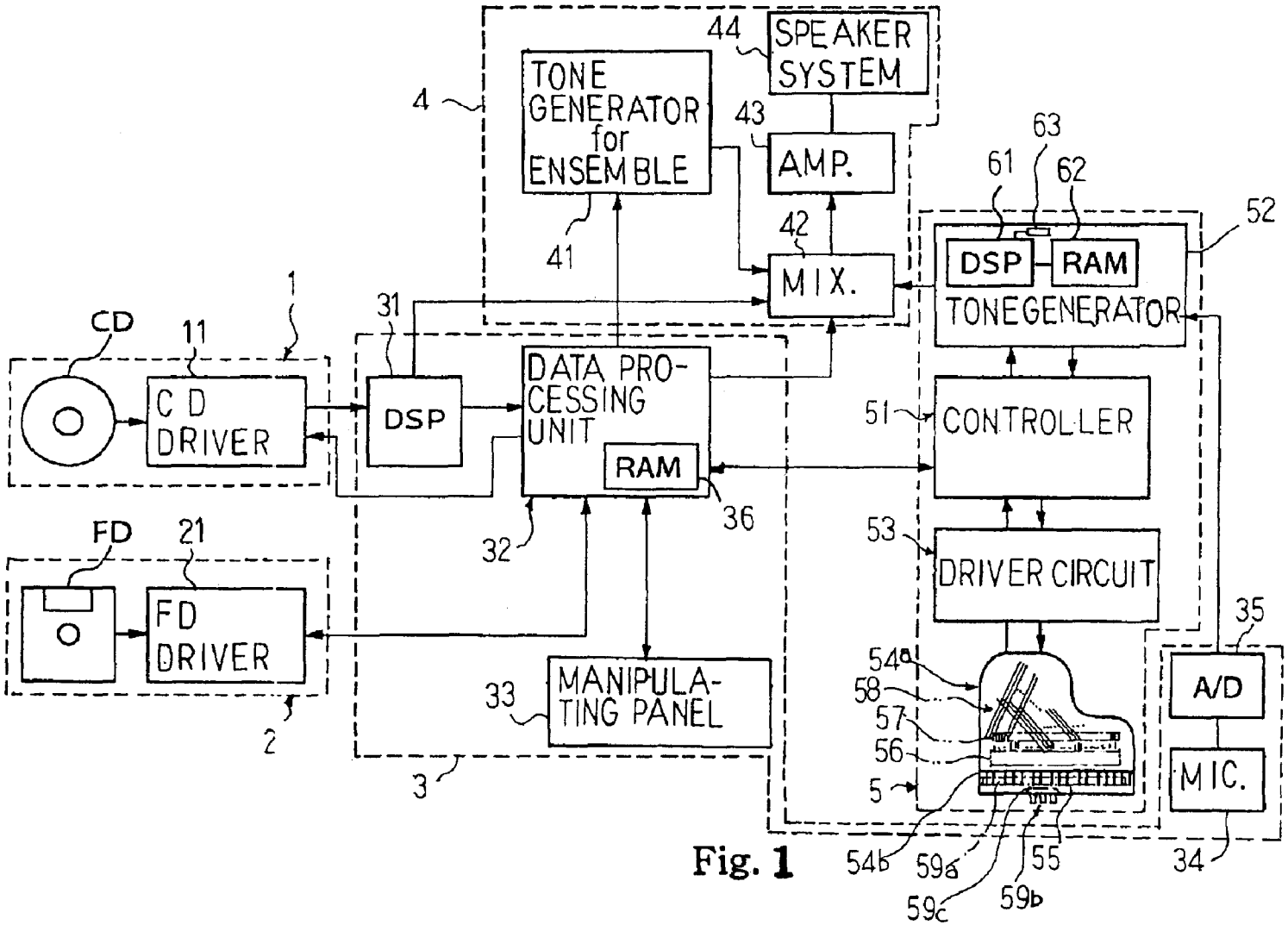
FIG. 1 is a block diagram showing the system configuration of an ensemble system according to the present invention.

Referring first to FIG. 1 of the drawings, an ensemble system embodying the present invention largely comprises plural music data sources 1/2, an ensemble controller 3 and plural sound sources 4/5. The ensemble controller 3 is connected to the music data sources 1/2 and sound sources 4/5, and has at least two modes of operation, i.e., a recording mode and a playback mode. In this instance, the sound source 4 produces electric tones from a digital tone signal, and the other sound source 5 produces acoustic tones or a digital tone signal on the basis of MIDI data codes. The music data source 1 outputs digital data codes representative of a piece of music or a part of the piece of music to the ensemble controller 3. The other music data source 2 stores a bibliographical information and a set of MIDI data codes representative of a piece of music or a part of the piece of music, and also supplies them to the ensemble controller 3. Those system components will be described hereinafter in detail.

Music Data Source 1

The music data source 1 includes a compact disc driver 11 and a compact disc CD. The pieces of music are represented by digital data codes, and have been recorded in the compact disc CD. Recording companies usually produce the compact discs CD. However, the user may personally produce the compact disc CD. At least two sorts of digital data codes are stored in the compact disc CD. The digital data codes of one sort form a table of contents, which is usually abbreviated as "TOC". An identification code assigned to the compact disc CD is incorporated in the table of contents. The digital data codes of the other sort are representative of the pieces of music and a lapse of time from the initiation of the playback. The digital data codes representative of the lapse of time are periodically inserted in the digital data codes representative of the pieces of music.

The compact disc CD is loaded into the compact disc driver. When the ensemble controller 3 gives an instruction for the playback, the compact disc CD is scanned with an optical head. The reflection on the compact disc CD is converted to the digital data codes, and the digital data codes are supplied from the compact disc driver 11 to the ensemble controller 3.

Music Data Source 2

Figure 2:
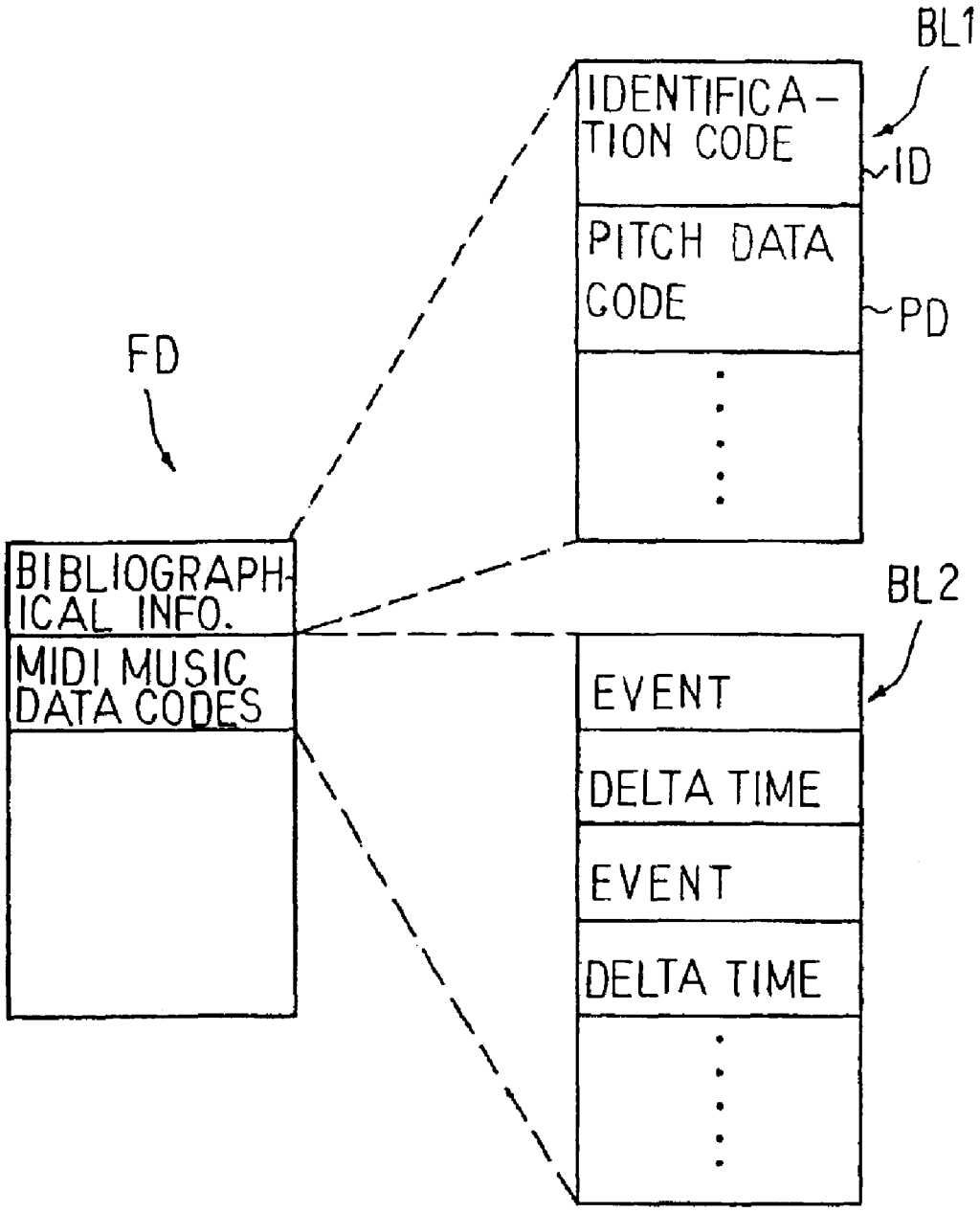
FIG. 2 is a view showing a data file established in a floppy disc.

The other music data source 2 includes a floppy disc driver 21 and a floppy disc FD. The floppy disc driver 21 has a data processing capability, and is responsive to instructions of the ensemble controller 3 so as to establish data files in the floppy disc FD and sequentially read out pieces of data information from the floppy disc FD. FIG. 2 shows a data file stored in the floppy disc FD. The data file includes a data block BL1 assigned to bibliographical information and another data block BL2 assigned to MIDI data codes representative of a piece of music.

An identification code ID and a pitch data code PD are examples of the bibliographical information. The identification codes ID have been assigned to the compact discs CD, respectively, and are obtainable from the compact disc CD loaded in the compact disc driver 1. The pitch data code PD is representative of the pitch of a unique tone stored in the compact disc CD. The ensemble controller 3 determines the pitch of the unique tone on the basis of the digital data codes stored in the compact disc CD before writing it in the data block BL1. The pitch data code PD is used for controlling the data read-out speed on the compact disc CD.

The MIDI music data codes include event codes representative of events to occur and duration codes representative of delta-time. The events are further broken down into note-on events and note-off events. The note-on event is representative of generation of a tone, and the note-off event is representative of decay of the tone. The delta-time is a time period between an event and the next event. In case where more than one event is to concurrently occur, the event codes are arranged without the duration code therebetween. While the floppy disc driver 21 is transferring the event codes to the ensemble controller 3, the floppy disc driver 21 reads out an event code from the floppy disc FD, stands idle for the delta-time, and reads out the next event code upon expiry of the delta-time. Thus, the floppy disc driver 21 is expected to serve as a sequencer so that the data processing capability is required for the floppy disc driver 21.

Another task given to the floppy disc driver 21 is to make the data readout from the floppy disc FD synchronous with the data read-out from the compact disc CD. The synchronous data read-out will be described in conjunction with the ensemble controller 3.

Ensemble Controller 3

Turning back to FIG. 1, the ensemble controller 3 includes a digital signal processor, i.e., DSP 31, a data processing unit 32, a manipulating panel 33, a microphone 34 and an analog-to-digital converter, i.e., AD 35. The data processing unit 32 is connected to the compact disc river 11, floppy disc driver 21, digital signal processor 31, manipulating panel 33 and sound sources 4/5.

Switches, control levers, indicators and a display window are arranged on the manipulating panel 33. A user gives instructions to the data processing unit 32 through the switches and/or control levers on the manipulating panel 33. The user has several options. One of the options is an ensemble between the sound sources 4 and 5, and another option is a solo through the sound source 4 or 5. The user can further select either electric or acoustic tones to be produced through the sound source 5. The user instructs the initiation of a performance, pause and termination of the performance to the data processing unit 32 through the manipulating panel 33.

The digital signal processor 31 is connected between the compact disc driver 11 and the data processing unit 32. When the user instructs the ensemble controller 3 to start a performance through the manipulating panel 33, the data processing unit 32 supplies control signals or signal to the compact disc driver 11 and/or the floppy disc driver 21 so as to start the data read-outs. The compact disc driver 11 reads out the digital data codes representative of the table of contents, and transfers the digital data codes to the data processing unit 32 through the digital signal processor 31.

The data processing unit 32 instructs the manipulating panel 33 to produce visual images representative of the table of contents on the display window. When the digital data codes reaches the digital signal processor 31, the digital signal processor 31 analyzes the digital data codes to see whether or not the digital data codes represent tones. If the answer is given negative, the digital signal processor 31 informs the data processing unit 32 of the negative answer, and the data processing unit 32 instructs the manipulating panel 33 to notify the user of the negative answer. On the other hand, when the answer is given affirmative, the digital signal processor 31 starts to supply the digital data codes representative of a piece of music to the data processing unit 32. While the compact disc driver 11 is transferring the digital data codes representative of the piece of music to the data processing unit 32, the digital signal processor 31 introduces a time delay of 250 milliseconds into the data transfer. The reason for the delay will be hereinafter described.

The microphone 34 is provided inside of the sound source 5, and picks up acoustic tones generated through the sound source 5. The microphone 34 is connected to the analog-to-digital converter 35, and supplies an analog tone signal representative of the waveform of the acoustic tones to the analog-to-digital converter 35. The analog-to-digital converter 35 converts the analog tone signal to a digital tone signal also representative of the acoustic tones, and supplies the digital tone signal to the tone generator for piano tones 52.

The data processing unit 32 has a data processor (not shown), a program memory (not shown) and a working memory such as random access memory, i.e., RAM 36. A memory location of the random access memory 36 is assigned to the pitch of an acoustic piano tone. When the pitch data code PD of the unique tone is read out from a floppy disc FD, the data processing unit 32 determines the offset value OF between the pitch of the acoustic piano tone and the pitch of the unique tone, and stores the offset value OF in another memory location in the random access memory 36. Thus, another memory location is assigned to an offset value OF between the pitch of the unique tone and the pitch of a corresponding acoustic piano tone. The role of the random access memory 36 will be hereinlater described in more detail.

While the digital signal processor 31 is transferring the digital data codes to the data processing unit 32, the data processing unit 32 produces audio data codes representative of a piece of music or a part of the piece of music from the digital data codes successively read out from the compact disc CD, and supplies the audio data codes to the sound source 4 as the digital tone signal. The other digital data codes are representative of the lapse of time from the initiation of the playback. The data processing unit 32 supplies the digital data codes representative of the lapse of time to the floppy disc driver 21. The reason why the data processing unit 32 supplies the digital data codes representative of the lapse of time to the floppy disc driver 21 is that the synchronous reproduction between the electronic tones on the basis of the digital data codes and the electronic/acoustic tones on the basis of the MIDI music data codes. The sound source 5 produces an acoustic tone from the event code or codes 500 milliseconds after the data read-out from the floppy disc FD. On the other hand, the sound source 4 immediately produces an electronic tone on the basis of the digital data codes representative of the electronic tone. In order synchronously to produce the acoustic tones and electronic tones, it is necessary to retard the generation of the acoustic tones by 500 milliseconds. The data processing unit 32 introduces a delay of 250 milliseconds between the initiation of the data read-out from the floppy disc FD and the initiation of the data read-out from the compact disc CD. The introduction of the other 250 milliseconds will be described in conjunction with the computer program for the playback.

While the floppy disc driver 21 is supplying the event codes to the data processing unit 32, the data processing unit 32 selectively transfers the event codes to the sound sources 4 and 5. The sound source 4 is assumed to be selected as the destination. The sound source 4 produces a digital tone signal on the basis of the event codes, and the digital tone signal is converted to electronic tones. On the other hand, if the user selects the sound source 5, the data processing unit 32 intermittently supplies the event codes to the other sound source 5. In case where the user has instructed the data processing unit 32 to produce acoustic tones, the sound source 5 analyzes the event codes, and produces acoustic tones on the basis of the event codes. Otherwise, if the user has instructed the data processing unit 32 to produce the electronic tones, the sound source 5 produces a digital tone signal on the basis of the event codes, and supplies the digital tone signal to the sound source 4 for generating the electronic tones.

The data processing unit 32 achieves the tasks through execution of computer programs stored in the program memory. Since the tasks relate to the functions of the sound sources 4/5, the sound sources 4/5 are described in detail, and the tasks of the data processing unit 32 will be described after the description on the sound sources 4/5.

Sound Source 4

The sound source 4 includes a tone generator for ensemble 41, a mixer 42, an amplifier 43 and a speaker system 44. The data processing unit 32 is connected to the tone generator for ensemble 41 and the mixer 42, and the tone generator for ensemble 41 is connected to the mixer 42. The mixer 42 is connected through the amplifier 43 to the speaker system 44.

The data processing unit 32 supplies the event codes to the tone generator for ensemble 41. The tone generator for ensemble 41 selectively reads out pieces of waveform data information depending upon the pieces of music data information represented by the event codes arrived thereat, and produces the digital tone signal. The digital tone signal is supplied from the tone generator for ensemble 41 to the mixer 42.

As described in conjunction with the data processing unit 32 and the other sound source 5, the digital tone signals are supplied from the data processing unit 32 and the other sound source 5 to the sound source 4. The mixer 42 receives those digital tone signals. The mixer 42 converts those digital tone signals to analog signals, and mixes them into an analog audio signal. The analog audio signal is supplied through the amplifier 43 to the speaker system 44 for producing electric tones.

Sound Source 5

The sound source 5 includes a controller 51, a tone generator for piano tones 52, a driver circuit 53, an automatic playing piano 54*a* and a recording system 54*b*. In this instance, the automatic playing piano 54*a* is based on a standard grand piano, and includes a keyboard 55, action units 56, hammers 57, strings 58 and solenoid-operated key actuators 59*a*. Black keys and white keys are incorporated in the keyboard 55, and are laid on the well-known patter. The solenoid-operated key actuators 59*a* are provided under the keyboard 55, and give rise to rotation of the associated black/white keys without any fingering of a human player.

The black/white keys are linked with the action units 56, respectively, and the hammers 57 are respectively drive for rotation by the associated action units 56. The strings 58 are stretched over the hammers 57, and are struck with the associated hammers 57 for generating acoustic piano tones. When a black/white key is sunk, the black/white key actuates the associated action unit 56, and the associated hammer 57 is driven for rotation. The hammer 57 strikes the associated string 58 at the end of the free rotation, and gives rise to vibrations of the string 58. The acoustic piano tone is radiated from the vibrating string 58.

The automatic player piano 54 further includes pedals 59*b* and solenoid-operated pedal actuators 59*c*. The pedals 59*a* may be a damper pedal, a soft pedal and a sustain pedal. The damper pedal is used for prolonging the tones, the soft pedal is used for lessening the loudness of the tones, and the sustain pedal is used for prolonging a particular tone or tones.

The recording system 54*b* includes key sensors, pedal sensors and hammer sensors. The key sensors monitor the black/white keys, and convert the current key positions to key position signals. Similarly, the hammer sensors monitor the hammers 57, and convert the current hammer positions to hammer position signals. The pedal sensors monitor the damper/soft and sustain pedals, and convert the current pedal positions to pedal position signals. The key position signals, pedal position signals and hammer position signals are supplied to the controller 51 for producing MIDI music data codes.

The controller 51 has a data processing capability, and selectively achieves given tasks through the execution of computer programs. One of the tasks is to transfer the event codes to the tone generator for piano tones 52. The behavior of the tone generator for piano tones 52 will be described hereinlater. Another task is to determine the magnitude of driving signals for the solenoid-operated key/pedal actuators 59*a*/59*c*. The user instructs his or her option to the data processing unit 32 through the manipulating panel 33, and the data processing unit 32 transfers the option to the controller 51.

The user is assumed to select the solenoid-operated key/pedal actuators 59*a*/59*c*. When the controller 51 receives an event code or event codes, the controller 51 calculates the velocity of a plunger of the associated solenoid-operated key actuator 59*a* or the solenoid-operated key/pedal actuators 59*a*/59*c*. The controller 51 informs the driver circuit 53 of the target value or values of plunger velocity. The driver circuit 53 determines the magnitude of the driving signals, and supplies the driving signal to the solenoid-operated key actuator 59*a* associated with the black/white key to be moved or the driving signals to the solenoid-operated key/pedal actuators 59*a*/59*c*. The driver circuit 53 supplies the driving signal or signals to the solenoid-operated key actuator 59*a* or solenoid-operated key/pedal actuators 59*a*/59*c* so that the plunger or plungers push the black/white key and or the pedal 59*b*. Thus, the black/white key and/or pedal 59*b* is moved without the fingering/step of the pianist.

Yet another task is to instruct the driver circuit 53 to remove the driving signal or signals from the solenoid-operated key actuator 59*a* and/or solenoid-operated key/pedal actuators 59*a*/59*c*. When the event representative of a note-off reaches the controller 51, the controller 51 instructs the tone generator for piano tones 52 to produce the digital tone signal representative of the decay of electronic tone/tones. Otherwise, the controller 51 instructs the driver circuit 53 to removes the driving signal from the solenoid-operated key actuator 59*a* and/or solenoid-operated pedal actuator 59*c*. The plunger or plungers are retracted, and the black/white key and/or plunger returns to the rest position.

A user is assumed to instruct the controller 51 to record his or her performance. While the user is fingering on the keyboard 55 and pedals 59*b*, the key sensors and hammer sensors periodically checks the associated black/white keys and pedals 59*b* for the key position signals and hammer position signals, and supply the key position signals and hammer position signals to the controller 51. The controller 51 periodically fetches pieces of key position data conveyed through the key position signals, pieces of hammer position data conveyed through the hammer position signals and pieces of pedal position data conveyed through the pedal position signals, and analyzes these pieces of data. The controller 51 specifies the depressed/released black/white keys and the depressed/released pedals, calculates the final hammer velocity immediately before striking the strings 58. The controller 51 produces the MIDI music data codes on the basis of the analysis, and supplies the MIDI music data codes to the ensemble controller 32.

The tone generator for piano tones 52 also has a data processing capability, and includes a data processor (not shown), a digital signal processor 61, a random access memory 62 and a dial 63. When the tone generator for piano tones 52 receives an event code or event codes, the tone generator for piano tones 52 accesses pieces of frequency data to be used for generating a corresponding electronic tone, and electronically produces the digital tone signal on the basis of the pieces of frequency data. The dial 63 is manipulated by a user, and the user gives an instruction for a pitch regulation to the digital signal processor 61. The digital signal processor 61 works on the digital tone signal. In detail, the digital signal processor 61 is responsive to the instruction given through the dial 63, and modifies the digital tone signal for varying the pitch of electronic tones to be produced. The digital tone signal is supplied from the tone generator for piano tones 52 to the mixer 42.

Tasks of Data Processing Unit 32

The ensemble system performs a piece of music in ensemble without any pitch difference or under the condition of a constant pitch difference as follows.

First, the ensemble controller 3 determines the pitches of the acoustic piano tones. A frequency analyzing technology is used for determining the pitches of the acoustic piano tones. The pitches of the acoustic tones are the values of the frequency of the fundamental tones forming the essential parts of the acoustic piano tones or the value of the frequency of a harmonic tone. Although higher-pitched tones have the widest amplitude in the fundamental tones, the second-order harmonic or the third-order harmonic has the widest amplitude in lower-pitched tones. Nevertheless, the frequency of the fundamental/harmonic tones with the widest amplitude is simply referred to as "fundamental pitches".

Pieces of pitch data are representative of the fundamental pitches. One of the black/white keys is predetermined, and the fundamental pitch of the acoustic piano tone produced by depressing the predetermined black/white key is referred to as the fundamental pitch of "predetermined key". With the fundamental pitches, the tone generator for piano tones 52 modifies pieces of frequency data stored therein for producing the digital tone signal. Thus, the electronic piano tones are to be consistent in pitch with the acoustic piano tones. The tone generator for piano tones 52 transfers the piece of pitch data through the controller 51 to the data processing unit 32. The data processing unit 32 stores the piece of pitch data in the memory location of the random access memory 36.

Subsequently, the ensemble controller 3 records the pieces of bibliographical information such as the identification code assigned to the compact disc CD and the pitch of the unique tone and, thereafter, a set or sets of MIDI music data codes in a floppy disc FD.

Finally, the ensemble controller 3 reproduces the tones from the digital data codes stored in the compact disc CD and the MIDI music data codes without any offset in pitch between the tones. The ensemble controller 3 may reproduce the tones on the condition that the tones produced from the MIDI music data codes are offset in pitch from the tones produced from the digital data codes by a predetermined value. Thus, the ensemble controller 3 achieves the three tasks through the following methods.

First Task

The first task starts with supply of the note-on event to the controller 51. The note-on event is representative of depressing the predetermined black/white key, and a user instructs the data processing unit 32 to supply the controller 51 the event code representative of the note-on through the manipulating panel 33.

When the controller 51 receives the event code, the controller 51 specifies the black/white key to be moved, and determines the velocity of the plunger of the associated solenoid-operated key actuator 59*a*. The controller 51 instructs the driver circuit 53 to supply the driving signal to the associated solenoid-operated key actuator 59*a*. The controller 51 determines the magnitude of the driving signal in order to project the plunger at the given velocity, and supplies the driving signal to the associated solenoid-operated key actuator 59*a*. The driving signal gives rise to the magnetic field, and causes the plunger to push the black/white key at the given velocity. The black/white key is rotated so as to actuate the action unit 56, and the action unit 56 drives the associated hammer 57 for rotation. The hammer 57 strikes the associated string 58 at the end of the free rotation, and the string 58 vibrates for generating the acoustic piano tone.

The microphone 34 converts the acoustic piano tone to the analog tone signal, and the analog-to-digital converter 35 converts the analog tone signal to the digital tone signal. The digital tone signal is supplied to the digital signal processor 61 of the tone generator for piano tones 52. The digital signal processor 61 analyzes the digital tone signal representative of the acoustic piano tone. Namely, the digital signal processor 61 acquires a set of digital data codes representative of the acoustic piano tone, and analyzes the digital data codes for a frequency spectrum. The digital signal processor 61 determines the fundamental pitch of the given acoustic piano tone.

The data processor compares the piece of pitch data representative of the fundamental pitch with the piece of frequency data representative of the fundamental tone of the corresponding electronic tone to see whether or not they are consistent with each other. If the answer is given negative, the data processor varies the piece of frequency data so that the electronic tone has the fundamental pitch equal to that of the acoustic piano tone. On the other hand, when the answer is given affirmative, the data processor does not vary the piece of frequency data.

The controller 51 repeats the above-described sequence so that all the electronic tones have the respective values of the fundamental pitch equal to those of the fundamental pitch of the electronic tones.

Upon completion of the calibration, the data processor if the tone generator for piano tones 52 specifies the piece of pitch data representative of the acoustic piano tone to be produced by depressing the predetermined key, and transfers the piece of pitch data through the controller 51 to the data processing unit 32. When the piece of pitch data arrives at the data processing unit 32, the data processing unit 32 stores the piece of pitch data in the memory location of the random access memory 36.

Second Task

Figure 3A:
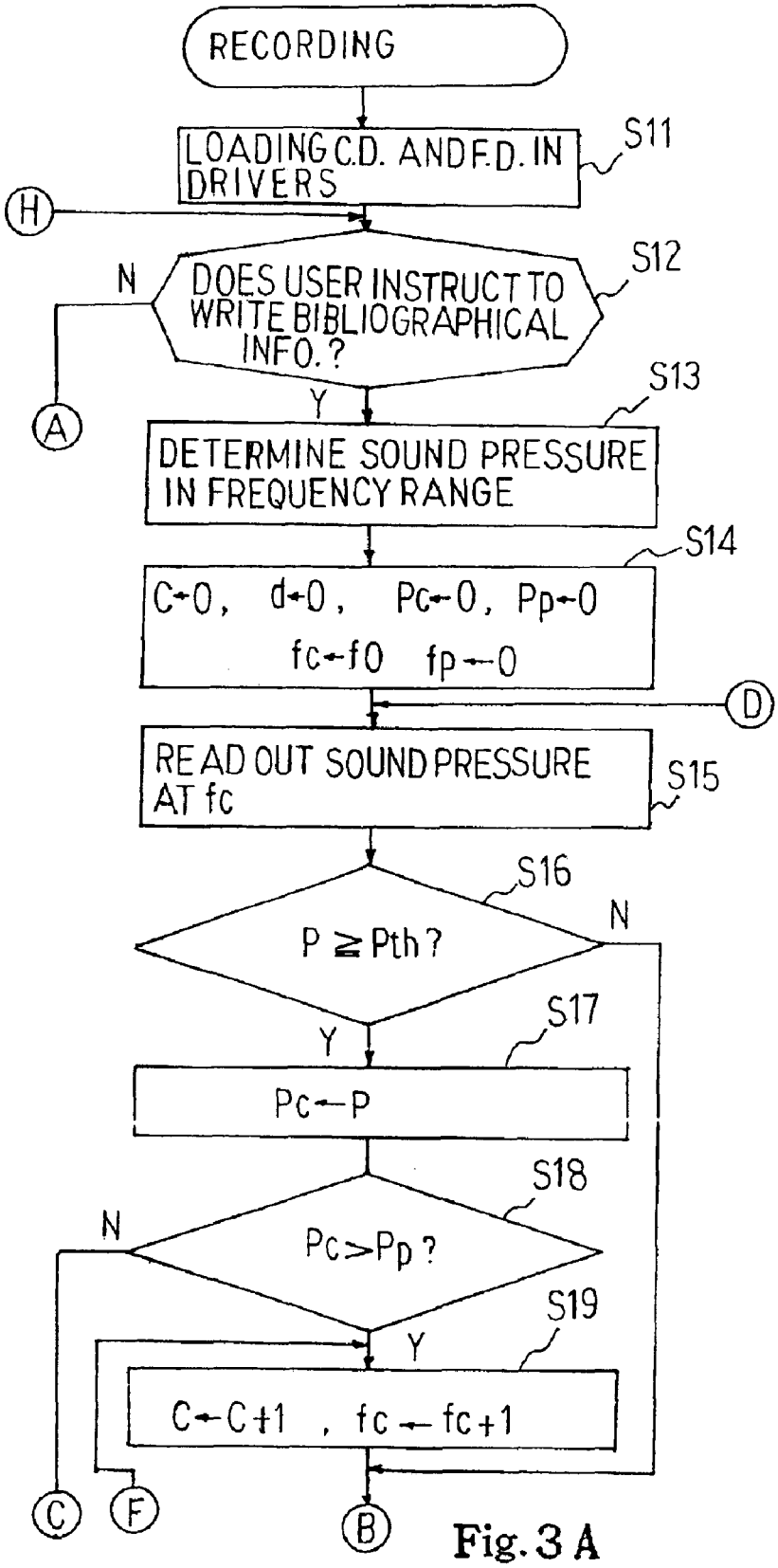
FIGS. 3A, 3B and 3C are flowcharts showing a method for recording a performance in a floppy disc.
Figure 3B:
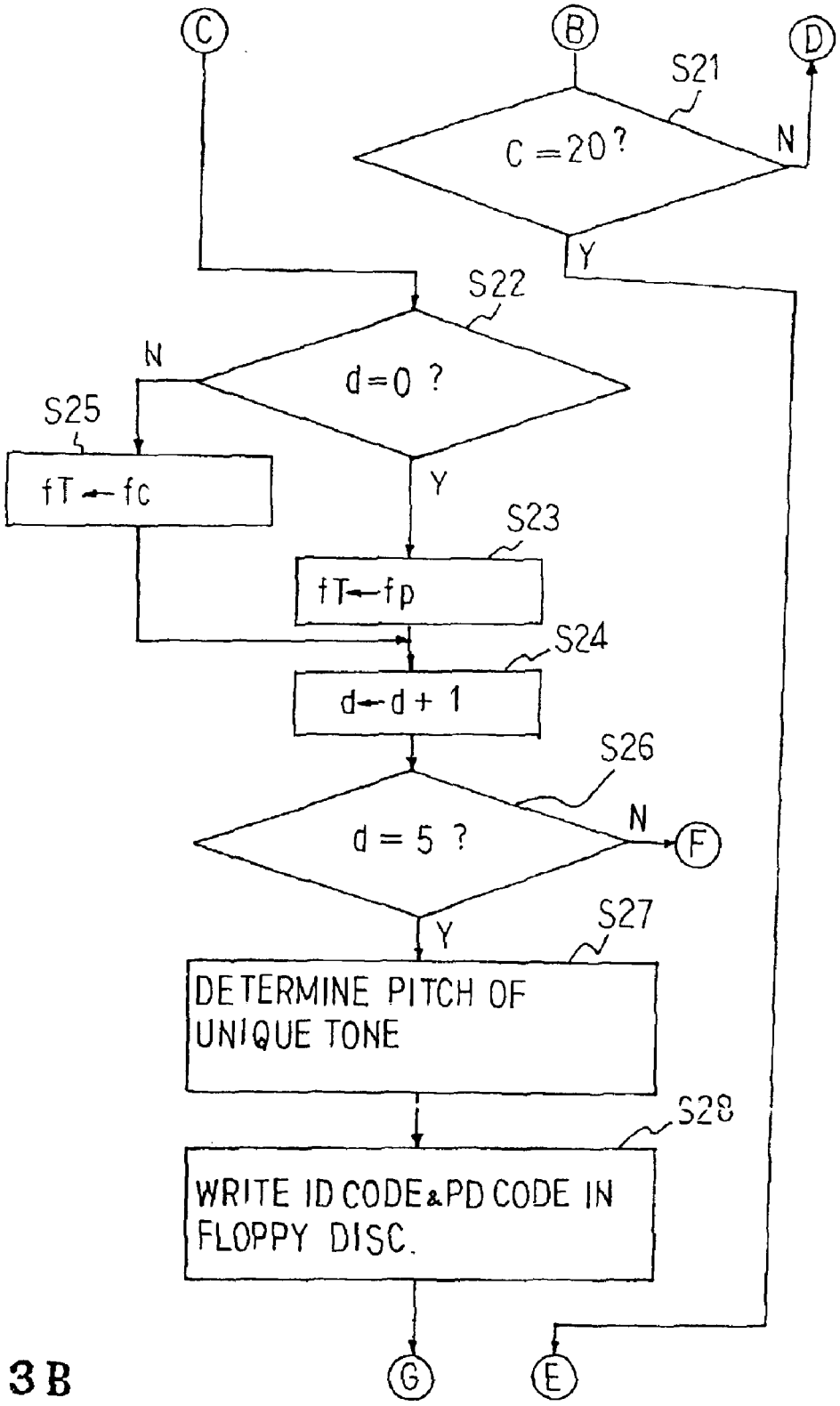
Figure 3C:
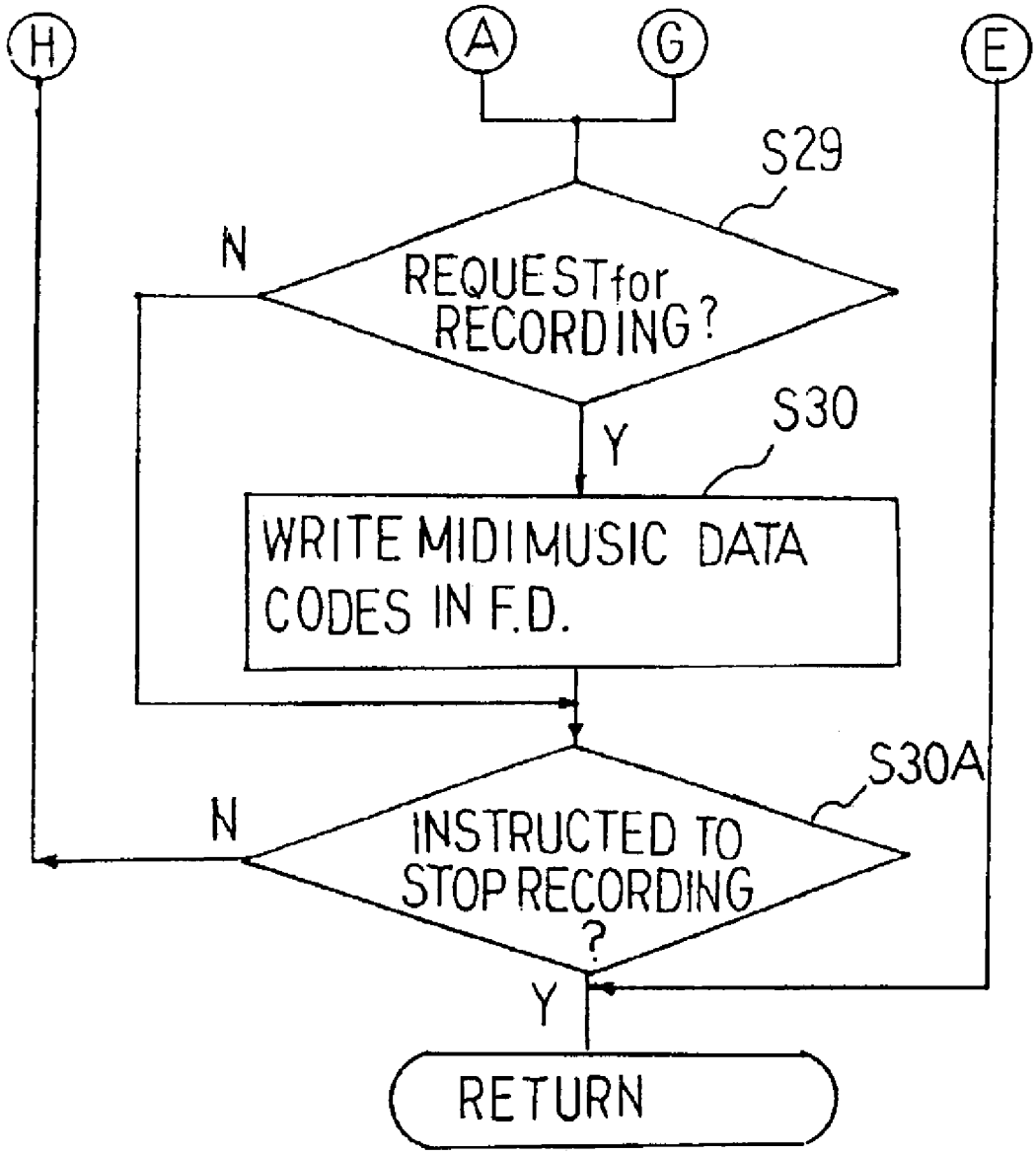

A performance on the automatic player piano 54 is recorded in a floppy disc FD as shown in FIGS. 3A and 3B. The recording starts with loading a compact disc CD and a floppy disc FD into the compact disc driver II and the floppy disc driver 21 as by step S11. The data processing unit 32 periodically checks the manipulating panel 33 to see whether or not the user instructs the data processing unit 32 to write the pieces of bibliographical information into the floppy disc FD as by step S12. If the user wishes to reproduce his or her performance in solo, the bibliographical information is not required for the user, and the answer is given negative "N". Then, the data processing unit 32 proceeds to step S29, and starts the recording without writing the bibliographical information in the floppy disc FD.

On the other hand, when the user wishes to reproduce his or her performance in ensemble with the other sound source 4, he or she manipulates the switch so as to instruct the data processing unit 32 to record his or her performance for the ensemble, and the answer is given affirmative "Y". The data processing unit 32 is responsive to the user's instruction so as to supply the control signal to the compact disc driver 11. When the compact disc driver 11 receives the control signal, the compact disc driver 11 reads out the digital data codes representative of a part of the piece of music from the compact disc CD, and supplies the digital data codes to the data processing unit 32. The data processing unit 32 further analyzes the audio data codes representative of the electronic tones for the sound pressure, and determines the values P of the sound pressure in a predetermined frequency range as by step S13. The data processing unit 32 stores the values P of the sound pressure in the memory locations in the random access memory 36 used as the working memory. The sound pressure may be represented by a finite value in decibel, i.e. dB.

Subsequently, the data processing unit 32 initializes several memory locations assigned to a counter C and registers d, Pc, Pp, fc and fp as by step S14. The counter C is indicative of the number of an execution loop already done, and the counter value is changed to zero at step S14. The register d is indicative of a frequency descent range, and the value stored therein is also changed to zero at step S14. The register fc is indicative of a present or target frequency value in the present execution loop, and the register fp is indicative of a previous frequency value in the previous execution loop. A finite certain value f0 is written in the register fc, and zero is written in the register fp at step S14. The certain value f0 may be 430 Hz. The register Pc is indicative of the sound pressure at the target frequency value fc, and the register Pp is indicative of the sound pressure at the previous frequency value fp. Zero is also written in the registers Pc and Pp. The certain value f0 is predetermined, and is usually close to the fundamental pitch of the acoustic piano tone produced by depressing the predetermined black/white key. Another memory location is assigned to a register fT for storing a peak frequency value or a frequency at which the sound pressure is maximized, and the peak frequency value fT is representative of the unique tone. The values stored in the counter/registers C/d/fc/fp/Pc/Pp/fT are also labeled with the same reference signs C/d/fc/fp/Pc/Pp/fT in the following description.

Upon completion of the initialization of the counter/registers C/d/fc/fp/Pc/Pp, the data processing unit 32 reads out the values P of the sound pressure at the target frequency value fc as by step S15, and checks the values P to see whether or not the sound pressure is equal to or greater than a threshold value Pth as by step S16. The threshold value Pth may be 100 dB. When the sound pressure P is too weak, the sound is never recognized as a fundamental tone, and the answer at step S16 is given negative "N". With the negative answer, the data processing unit 32 proceeds to step S20, and changes the target sound pressure to be examined as will be described hereinlater in detail.

On the other hand, when the sound pressure P is larger in value than the threshold Pth, there is a possibility that the data processing unit 32 finds the unique tone, and the answer is given affirmative "Y". The data processing unit 32 proceeds to step S17, and writes the sound pressure value P in the register Pc.

Subsequently, the data processing unit 32 increments the counter value C and the target frequency value fc by one as by step S19. When the answer at step S16 is given negative, the data processing unit 32 also increments the counter value C and the target frequency value fc by one without execution at steps S17, S18 and S19. In this instance, the frequency range to be examined is 20 Hz, and the data processing unit 32 checks the counter C to see whether or not the counter value C reaches twenty as by step S21. If the data processing unit 32 has not completed the examination in the predetermined frequency range, the answer at step S21 is given negative "N", and the data processing unit 32 returns to step S15 for reading out the sound pressure value at the new target frequency fc. While the sound pressure P at the target frequency fc is being gradually increased, the data processing unit 32 repeats the loop consisting of steps S15, S16, S17, S18, S19, S20 and S21, and increments the target frequency fc.

On the other hand, when the data processing unit 32 completed the execution loop twenty times without any peak value fT, the answer at step S21 is given affirmative, and the data processing unit 32 terminates the second task.

Assuming now that the sound pressure value Pc is less than the previous sound pressure value Pp, the answer at step S18 is given negative "N", and the data processing unit 32 checks the register d to see whether or not the frequency descent range d is zero as by step S22. The data processing unit 32 wrote zero in the register d at step S14 so that the answer at step S22 is to be given affirmative "Y" at the first change from the positive answer to the negative answer at step S18. With the positive answer "Y", the data processing unit 32 temporarily determines that the previous frequency value fp is the peak frequency value fT as by step S23, and stores the previous frequency value fp as the peak frequency value ff. The data processing unit 32 increments the frequency descent range d by one as by step S24.

On the other hand, if the decrease of sound pressure is continued from the previous execution, the answer at step S22 is given negative "N", and the data processing unit 32 temporarily stores the target frequency value fc in the register fT as the peak frequency value fT as by step S25. The data processing unit 32 proceeds to step S24, and increments the frequency descent range d.

Upon completion of the execution at step S23 or S25, the data processing unit 32 checks the register d to see whether or not the frequency descent range d is continuously increased five times as by step S26. If the answer at step S26 is given negative "N", the data processing unit 32 returns to step S19, and stores the target frequency value fc and the value Pc of sound pressure in the registers fp and Pp as the previous frequency value fp and previous sound pressure value Pp. Thus, the data processing unit reiterates the execution loop consisting of steps S15 to S26, and tries to find the peak frequency value ff.

The sound pressure P is assumed to continue five times. The answer at step S26 is given affirmative, and the data processing unit 32 finally determines that the frequency value in the register fT represents the unique tone as by step S27. The data processing unit 32 supplies the control signal to the compact disc driver 11 for reading out the digital data codes representative of the table of content. The data processing unit 32 determines the identification code ID assigned to the compact disc CD, and writes the pieces of bibliographical information, i.e. the identification code ID and the pitch data code PD representative of the pitch of the unique tone in the data block BL1 in the floppy disc FD as by step S28. The data processing unit 32 stores the pitch of the unique tone in the memory location in the random access memory 36. Then, the data processing unit 32 completes the job given by the user at step S12.

Upon completion of the job at step S28, the data processing unit 32 waits for an instruction for recording the performance on the keyboard 55, and periodically checks the manipulating panel 33 to see whether or not the user gives the instruction for the recording as by step S29. The answer at step S29 is given negative "N" until the user instructs the data processing unit 32 to record the performance on the keyboard 55, and the data processing unit 32 further checks the manipulating panel 33 to see whether or not the user wishes to stop the recording as by step S31. If the answer at step S31 is given negative "N", the data processing unit 32 returns to step S12, and checks the manipulating panel 33 to see whether or not the user gives the instruction to record the pieces of bibliographical information. The pieces of bibliographical information have been already written in the data block BL1, and the answer is given negative "N". The data processing unit 32 proceeds to step S29, and reiterates the loop consisting of steps S12, and S29–S31 until the answer at step S12, S29 or S30 is changed to positive.

The user is assumed to give the instruction to record the performance on the keyboard 55 at step S29. The answer at step S29 is changed to affirmative, and the central processing unit 32 starts to record the performance on the keyboard 55 in the form of MIDI music data codes in the data block BL2 of the floppy disc FD as by step S30. While the user is fingering a piece of music on the keyboard 55, the key, hammer and pedal sensors supply the key position signals, hammer position signals and pedal position signals to the controller 51, and the controller 51 produces the MIDI music data codes on the basis of the pieces of key position data, pieces of hammer position data and pieces of pedal position data. The controller 51 supplies the MIDI music data codes to the data processing unit 32, and is finally stored in the data block BL2 of the floppy disc FD as by step S30A.

When the user completes the performance, he or she gives an instruction to stop the recording to the data processing unit 32. Then, the answer at step S31 is changed to the affirmative "Y", and the data processing unit 32 terminates the execution.

Third Task

Figure 4A:
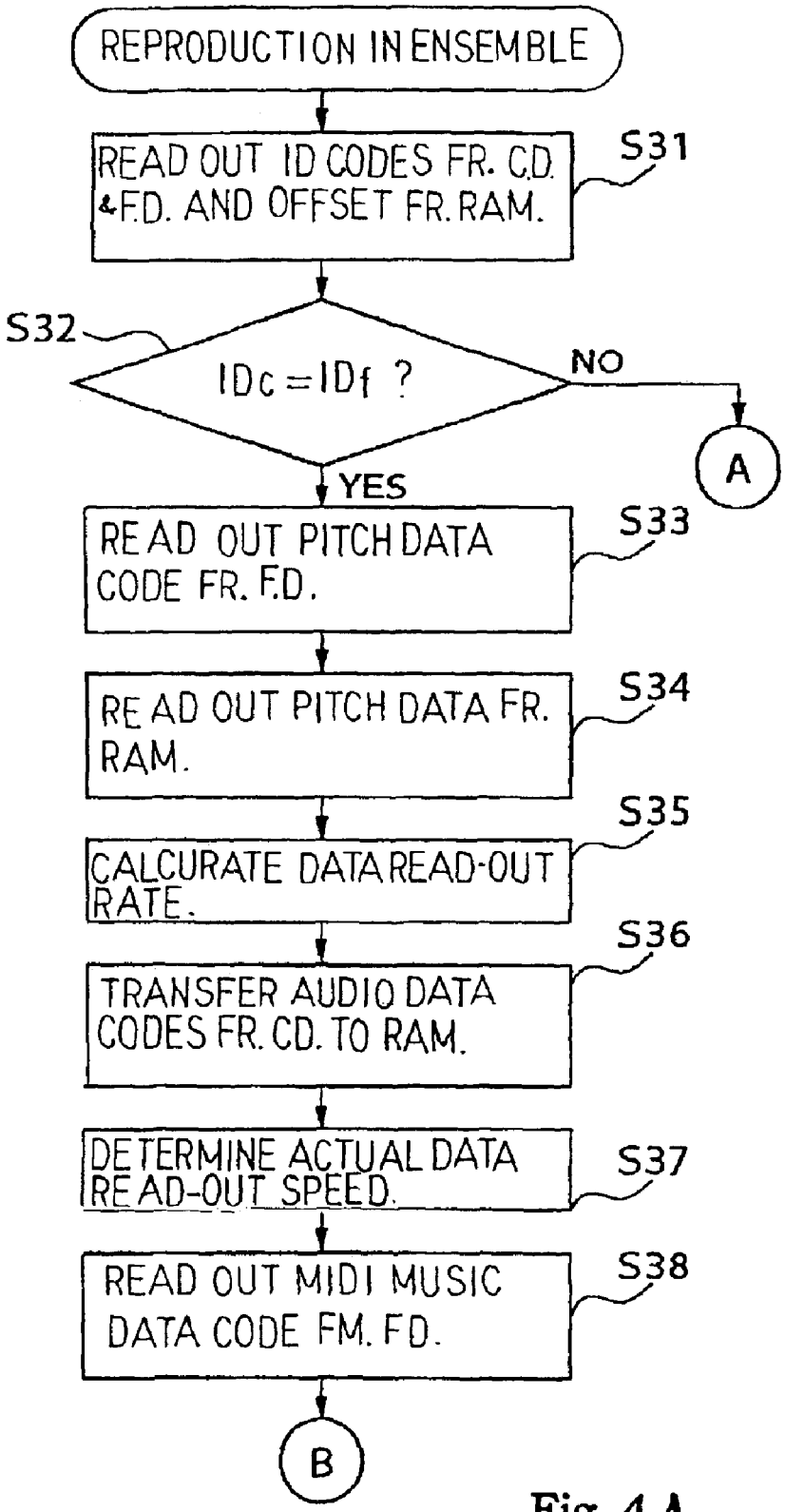
FIGS. 4A and 4B are flowcharts showing a method for reproducing an ensemble.
Figure 4B:
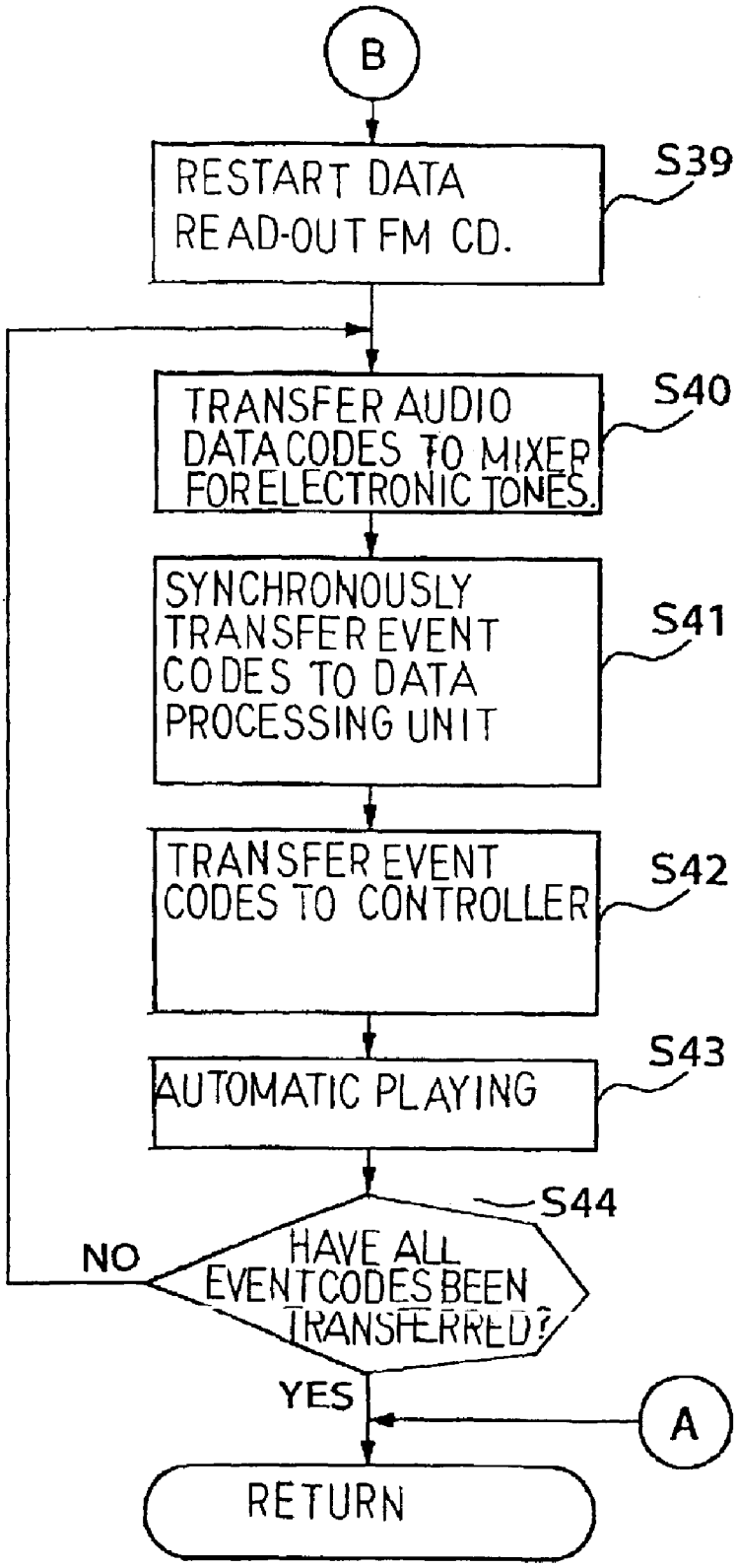

FIGS. 4A and 4B shows a method for reproducing an ensemble. The method starts with loading the floppy disc FD and the compact disc CD in the respective drivers 11/21. The user gives an offset value in pitch between the electronic tones and the electronic tones through the manipulating panel 33, and the offset value is written in the memory location of the random access memory 36. If the user wishes to produce an ensemble without any pitch difference, the offset value is to be zero. When the user fixes the offset value to +1, the electronic tones are higher in pitch than the piano tones by 1 Hz. Similarly, when the user fixes the offset value to −1, the electronic tones are lower in pitch than the piano tones by 1 Hz. The listeners hear the electronic tones or piano tones floating on the piano tones or electronic tones under the condition that an appropriate offset value has been given to the ensemble controller 3.

The data processing unit 32 firstly reads out the identification codes ID from the compact disc CD and floppy disc FD, and further reads out the offset value from the random access memory 36 as by step S31. The identification code ID read out from the compact disc CD and identification code ID read out from the floppy disc FD are hereinafter labeled with "IDc" and "IDf", respectively. The data processing unit 32 compares the identification code IDc with the identification code IDf to see whether or not they are consistent with each other as by step S32. In this instance, the job at the step S32 is to be completed within 250 milliseconds from the initiation of the data read-out. However, the time period for the comparison may be longer or shorter than 250 milliseconds in other ensemble systems according to the present invention. In other words, 250 milliseconds are not unchangeable time period.

If the compact disc CD loaded in the compact disc driver 11 is different from the compact disc CD used in the recording, it is impossible to control the pitch difference between the electronic tones and the piano tones at the given offset value, because the pitch of the unique tone is unknown. For this reason, the answer at step S32 is given negative "NO", and the ensemble controller 3 informs the user that the ensemble is impossible.

On the other hand, when the compact disc CD loaded in the compact disc driver 11 is same as the compact disc CD used in the recording, the answer at step S32 is given affirmative "YES", and the data processing unit 32 reads out the pitch data code PD from the data block BL1 of the floppy disc FD as by step S33.

Subsequently, the data processing unit 32 reads out the piece of pitch data representative of the piano tone produced by depressing the predetermined black/white key from the memory location of the random access memory 36 as by step S34. The data processing unit 32 determines a data read-out rate RATE as by step S35. The data read-out rate RATE is given as follows.

$$RATE=(PITCH1+OF)/PITCH2$$

where PITCH1 is the fundamental pitch of the piano tone measured by the tone generator for piano tones 52, OF is the offset value and PITCH2 is the pitch of the unique tone corresponding to the piano tone.

Subsequently, the data processing unit 32 requests the compact disc driver 11 to transfer the audio data codes for a part of the piece of music thereto, and transfers the audio data codes through the controller 51 to the tone generator for piano tones 52 for storing the audio data codes in the random access memory 62 as by step S36. The part of the piece of music may be equivalent to the electronic tones to be successively produced for 30 seconds at the regular data read-out speed.

Subsequently, the data processing unit 32 determines an actual data read-out speed f as by step S37, and the actual data read-out speed f is given as $$f=f0\times RATE$$

where f0 is the regular data read-out speed and RATE is the data read-out rate. The regular data read-out speed f0 is predetermined for the compact discs, and may be 44.1 kHz. While the digital signal processor 61 is transferring the audio data codes from the random access memory 62 to the mixer 42 at the actual data read-out speed f, the electronic tones are radiated from the speaker system 44. However, the electronic tones are higher in pitch than the electronic tones produced from the audio data codes directly transferred from the compact disc driver 11 to the mixer 42 by the offset value. If the offset value is zero, the electronic tones are ensembled with the piano tones without any pitch difference. Thus, a pitch controller is built in the ensemble controller 3.

The reason why the pitches of the electronic tones are controlled is that an amateur hardly adjusts the acoustic piano tones to target pitches. On the other hand, the electronic tones are easily adjusted to target pitches by changing the actual data read-out speed.

Subsequently, the data processing unit 32 firstly instructs the floppy disc driver 21 to read out the MIDI data codes as by step S38, and, thereafter, instructs the compact disc driver 11 to restart the data read-out as by step S39.

As described hereinbefore, the digital data codes representative of the part of the piece of music were transferred to the random access memory 62 at step S36. The compact disc driver 11 reads out the digital data codes representative of the remaining part of the piece of music from the compact disc CD, and transfers the digital data codes representative of the remaining part of the piece of music to the data processing unit 32. The data processing unit 32 further transfers the digital data codes through the controller 51 to the tone generator for piano tones 52 for storing them in the random access memory 62. When the digital data codes representative of the lapse of time are read out from the compact disc CD, the digital signal processor 31 transfers the digital data codes representative of the lapse of time to the data processing unit 32, and the data processing unit 32 transfers the digital data codes representative of the lapse of time to the floppy disc driver 21.

When the data processing unit 32 gives the instruction for the data read-out to the floppy disc driver 21, the data processing unit 32 starts to measure a predetermined time period. In this instance, the predetermined time period is 250 milliseconds. Upon expiry of the predetermined time period, the data processing unit 32 instructs the digital signal processor 61 to transfer the audio data codes representative of the piece of music from the random access memory 62 to the mixer 42 as by step S40 at the actual data read-out speed f. The mixer 42 converts the audio data codes to the analog audio signal, and the analog audio signal is supplied through the amplifier 43 to the speaker system 44. The speaker system 44 converts the analog audio signal to the electronic tones.

When the data processing unit 32 instructs the floppy disc driver 21 to read out the MIDI music data codes (see step S38), the floppy disc driver 21 starts to sequentially read out the MIDI music codes. As described hereinbefore, the set of MIDI music data codes includes the event codes and duration codes representative of the delta time between the events. The floppy disc driver 21 makes the transfer of the event codes synchronized with the corresponding audio data codes by using the digital data codes transferred through the data processing unit 32 and the duration codes. The event codes are supplied from the floppy disc driver 21 to the data processing unit 32 at the appropriate timing as by step S41, and the data processing unit 32 transfers the event codes to the controller 51 as by step S42.

The controller 51 instructs the driver circuit 53 to selectively supply the driving signal to the solenoid-operated key/pedal actuators 59*a*/59*c*. With the driving signal, the solenoid-operated key/pedal actuators 59*a*/59*c* selectively move the associated black/white keys and pedals 59*b* so that the acoustic piano tones are generated through the vibrations of the strings 58. In other words, the acoustic piano tones are produced through the automatic playing as by step S43.

Thus, the piece of music is reproduced in ensemble between the sound sources 4 and 5. Since the audio data codes are read out at the actual data read-out speed, which is equal to the product between the regular data readout speed and the rate RATE, the pitches of the electronic tones are consistent with the pitches of the acoustic piano tones, or are different therefrom by the constant value.

Subsequently, the data processing unit 32 checks the event codes to see whether or not the all the event codes have been already transferred to the controller 51 as by step S44. While the answer is given negative, the data processing unit 32 returns to step S40, and reiterates the loop consisting of steps S40 to S44 for reproducing the performance in ensemble. When the last event code is transferred to the controller 51, the answer at step S44 is changed to affirmative, and the data processing unit 32 stops the execution.

As will be understood from the foregoing description, the pitch difference between the acoustic piano tone and the corresponding unique tone is calculated before the reproduction of an ensemble, and the digital audio signal representative of the electronic tones is produced from the audio data codes at the actual data read-out speed. The actual data read-out speed is changed depending upon the pitch difference so that the electronic tones are appropriately controlled in pitch. When the user wishes to reproduce the ensemble without any pitch difference between the electronic tones and the acoustic piano tones, the electronic tones are harmonized with the acoustic piano tones. If the user wishes to make the acoustic piano tones impressive, the ensemble system keeps the pitch difference between the electronic tones and the acoustic piano tones constant so that the listener enjoys the ensemble as if the acoustic piano tones floats over the electronic tones.

Although particular embodiments of the present invention have been shown and described, it will be apparent to those skilled in the art that various changes and modifications may be made without departing from the spirit and scope of the present invention.

The digital data codes may be supplied to the ensemble controller through the Internet or a local area network. The digital data codes may be stored in an MO (Magneto-Optical) disc, a CD-R (Compact Disc-Recordable), a CD-RW (Compact Disc-ReWritable), DVD-R (Digital Versatile Disc-Rewitable), a hard disc, a flexible disc or another sort of information storage medium.

Any sort of acoustic musical instrument is available for the ensemble in so far as the acoustic musical instrument can change the pitches of tones. Examples of the acoustic musical instrument are stringed instruments, wind instruments and keyboard instruments.

The ensemble controller makes the pitches of the first sort of tones different from the pitches of the second sort of tones by several Hz. This feature is desirable for an ensemble between an orchestral accompaniment reproduced from a compact disc and an automatic player piano, by way of example, because the piano tones are brought into relief. Thus, the intentional pitch difference enhances the artistic representation of the ensemble.

The target frequency fc may be stepwise decreased by 1 Hz.

The pitch control technique described in conjunction with steps S35 to S37 is an example. Any known pitch control technique is available for the ensemble.

In the embodiment described hereinbefore, the user gives an arbitrary offset value from the manipulating panel 33. However, several options such as 0, ±1, ±2, . . . may be stored in a non-volatile memory before delivery to user. In this instance, the user can select his or her option from the menu so that the offset value is easily given to the data processing unit 32.

The ensemble system is available for an ensemble among the electronic tones produced from the audio data codes, acoustic piano tones and electronic tones produced on the basis of event codes. As described hereinbefore, a set of MIDI music data codes are produced through the fingering on the keyboard 55, and are recorded in the floppy disc FD. If the user writes another set of MIDI music data codes with a tag representative of the tone generator for ensemble 41 or tone generator for piano tones 52, these MIDI music data codes are supplied to the tone generator for ensemble 41 or tone generator for piano tones 52, and the MIDI music data codes representative of the performance are used for the automatic playing. This results in the ensemble among the tone generator for ensemble 41/tone generator for piano tones 52 and automatic player piano 54*a*.

If the two sorts of tones are to be always produced without any pitch difference, any memory location is not assigned to the offset value, and the switches for selecting the offset value are removed from the manipulating panel 33. This results in a simple ensemble system.

Any sort of musical instrument such as, for example, a stringed instrument, a wind instrument or another sort of keyboard instrument is available for the ensemble system according to the present invention in so far as the musical instrument produces the MIDI music data codes. If the musical instrument is provided with an automatic playing system, the automatic playing piano is replaceable with the musical instrument.

A human pianist may perform a piece of music in ensemble with the electronic tones produced from the audio data codes. If the piano is not provided with the automatic playing system, the human pianist depresses the predetermined black/white key for determining the fundamental pitch of the acoustic piano tone. The ensemble controller determines the pitch of the corresponding electronic tone on the basis of the audio data code or codes, and calculates the actual data read-out speed as similar to the above-described embodiment. While the human pianist is fingering on the keyboard 55, the audio data codes are read out at the actual data read-out speed, and are transferred to the sound source 4. The electronic tones are varied so that the human player enjoys the ensemble with the sound source 4 in good harmony.

If difference between the recording time on a compact disc CD and the playback is serious, the delta time between the events may be varied by using a time stretching technique.

The ensemble system may be built in the automatic player piano. Otherwise, the compact disc driver and floppy disc driver may be connected to an appropriate interface of the ensemble controller through suitable cables.

A hard disc driver may be further incorporated in the ensemble system. In this instance, the audio data codes are transferred from the compact disc to the hard disc, and are read out from the hard disc at the actual data read-out speed for changing the pitches of the electronic tones. One of the attractive points is that the compact disc driver 11 is replaceable with a CD-R driver or a CD-RW driver. Another attractive point is that the ensemble controller can carry out the recording and the data transfer to the hard disc in parallel.

The fundamental pitch may be determined as follows. First, a user depresses the predetermined black/white key for producing the acoustic piano tone. Concurrently, the tone generator for piano tones 52 produces the digital tone signal corresponding to the acoustic piano tone, and an electronic tone is generated from the digital tone signal. If the pitch of the acoustic piano tone is not equal to the pitch of the electronic tone, beat takes place between the acoustic piano tone and the electronic tone. Then, the user turns the dial 63 for changing the digital data codes representative of the pitches of the electronic tones. The user depresses the predetermined black/white key, again, and the corresponding electronic tone is concurrently generated to see whether or not the beat takes place. The user repeats the above-described steps until the acoustic piano tone and corresponding electronic tone do not generate the beat.

The methods for the tasks may be expressed by computer programs, which are loaded into the ensemble controller before the ensemble. The computer programs are stored in a suitable information storage medium. Otherwise, the computer programs are loaded into the ensemble controller through a suitable network such as, for example, the Internet, a commercial network or a local area network. The computer programs may be given to the ensemble controller in the form of object codes, a program executed by an interpreter or script data supplied to the operating system. The ensemble controller may sequentially read out instruction codes stored in an information storage medium.

A random access memory, a flexible disc, an optical disc, an optomagnetic disc, a CD-ROM, a MO, CD-R, CD-RW, a DVD, i.e., DVD-ROM and DVD-R, a magnetic tape, a non-volatile memory card and other sorts of ROMs are used as the information storage medium.

What is claimed is:

1. An ensemble system for concurrently producing a first sort of tones and a second sort of tones, comprising:

a first sound source for producing said first sort of tones;

a second sound source for producing said second sort of tones;

a first data source storing pieces of music data information representative of said first sort of tones; and an ensemble controller connected to said first sound source, said second sound source and said first data source, and achieving at least first, second and third tasks for producing said first sort of tones concurrently with said second sort of tones, said ensemble controller determining a pitch of one of said tones of said second sort actually produced by said second sound source in said first task, said ensemble controller determining a data read-out speed on the basis of a ratio between said pitch of said one of said tones and a pitch of a corresponding tone of said first sort to be equivalent in pitch to said one of said tones through an analysis on selected ones of said pieces of music data information in said second task for adjusting said tones of said first sort to pitches different from the pitches represented by said pieces of music data information by a predetermined offset value, said ensemble controller transferring said pieces of music data information from said first data source to said first sound source at said data read-out speed in said third task so that said first sound source produces said tones of said first sort concurrently with said tones of said second sort produced by said second sound source.

2. The ensemble system as set forth in claim 1, in which said predetermined offset value is zero.

3. The ensemble system as set forth in claim 1, in which said predetermined offset value is equal to a finite number.

4. The ensemble system as set forth in claim 3, in which said finite number is an integer.

5. The ensemble system as set forth in claim 1, in which said second sound source includes an acoustic musical instrument.

6. The ensemble system as set forth in claim 5, in which said acoustic musical instrument is equipped with an automatic playing system.

7. The ensemble system as set forth in claim 6, in which said acoustic musical instrument equipped with said automatic playing system is an automatic player piano so that said ensemble controller instructs said automatic playing system to move a key for producing said one of said tones without any fingering of a human player.

8. The ensemble system as set forth in claim 1, further comprising a second data source connected to said ensemble controller, wherein said ensemble controller further achieves a fourth task to store other pieces of music data information representative of said tones of said second sort produced by said second sound source in said second data source and a fifth task to transfer said other pieces of music data information for causing said second sound source to produce said tones of said second sort concurrently with said tones of said first sort.

9. The ensemble system as set forth in claim 8, in which said other pieces of music data information are stored in a set of MIDI (Musical Instrument Digital Interface) music data codes, and said other pieces of music data information are stored in a series of digital data codes to be stored in a compact disc.

10. The ensemble system as set forth in claim 8, in which said ensemble controller further achieves a sixth task to store an identification code assigned to said first data source and said pitch data code representative of said pitch of said corresponding tone in said second data source and a seventh task to compare said identification code read out from said second data source with an identification code read out from said first data source to see whether or not said identification codes are consistent with each other.

11. The ensemble system as set forth in claim 1, in which said ensemble controller seeks a pitch with a maximum sound pressure among said selected ones of said pieces of music data information for specifying said corresponding tone in said second task.

12. The ensemble system as set forth in claim 11, in which said ensemble controller starts to seek said pitch with said maximum sound pressure at a certain pitch around to said pitch of said one of said tones, and sequentially changes said certain pitch for specifying said corresponding tone.

13. The ensemble system as set forth in claim 1, in which said ensemble controller includes a microphone for converting said one of said tones of said second sort to an analog tone signal, a data converter connected to said microphone for converting said analog signal to a digital tone signal and an information processor connected to said data converter and analyzing said digital tone signal for determining said pitch of said one of said tones of said second sort.

14. The ensemble system as set forth in claim 1, in which said first data source includes a compact disc driver and a compact disc for storing said pieces of music data information, and said compact disc driver usually reads out said pieces of music data information from said compact disc at a regular data read-out speed.

15. The ensemble system as set forth in claim 14, in which said regular data read-out speed is multiplied by said ratio for determining said data read-out speed.

16. A method for producing a first sort of tones concurrently with a second sort of tones, comprising the steps of:

imputing a piece of music data information representative of one of the tones of said second sort;

receiving said piece of music data information representative of said one of said tones;

retrieving a piece of music data information representative of a corresponding tone of said second sort to be equivalent in pitch to said tones from an information storage;

receiving said piece of music data information representative of said corresponding tone;

determining a pitch of said one of the tones of said second sort and a pitch of said corresponding tone of said first sort;

determining a data read-out speed on the basis of a ratio between said pitch of said one of said tones and said pitch of said corresponding tone for adjusting said tones of said first sort to pitches different from the pitches of said tone of said first sort by an offset value; and reading out pieces of music data information representative of said tones of said first sort from said information storage medium at said data read-out speed for producing said tones of said first sort concurrently with said tones of said second sort.

17. The method as set forth in claim 16, in which said offset value is zero.

18. The method as set forth in claim 16, in which said offset value is a finite number.

19. An information storage medium storing a computer program representative of a method for producing a first sort of tones concurrently with a second sort of tones, said method comprising the steps of:

inputting a piece of music data information representative of one of the tones of said second sort;

receiving said piece of music data information representative of said one of said tones;

retrieving a piece of music data information representative of a corresponding tone of said second sort to be equivalent in pitch to said one of said tones from an information storage;

receiving said piece of music data information representative of said corresponding tone;

determining a pitch of said one of the tones of said second sort and a pitch of said corresponding tone of said first sort;

determining a data read-out speed on the basis of a ratio between said pitch of said one of said tones and said pitch of said corresponding tone for adjusting said tones of said first sort to pitches different from the pitches of said tone of said first sort by an offset value; and reading out pieces of music data information representative of said tones of said first sort from said information storage medium at said data read-out speed for producing said tones of said first sort concurrently with said tones of said second sort.

* * * * *